US007318389B2

(12) United States Patent
Boning

(10) Patent No.: US 7,318,389 B2
(45) Date of Patent: Jan. 15, 2008

(54) DEVICE AND METHOD FOR CONTROLLING TRIMMING FLAPS ON A WATERCRAFT, AS WELL AS A WATERCRAFT HAVING A CORRESPONDING DEVICE

(75) Inventor: Gunther Boning, Delmenhorst (DE)

(73) Assignee: Boning Automationstechnologie GmbH & Co. KG, Ganderkesee (DE)

( * ) Notice: Subject to any disclaimer, the term of this patent is extended or adjusted under 35 U.S.C. 154(b) by 0 days.

(21) Appl. No.: 11/462,238

(22) Filed: Aug. 3, 2006

(65) Prior Publication Data

US 2007/0077829 A1 Apr. 5, 2007

(30) Foreign Application Priority Data

Oct. 5, 2005 (DE) ..... 10 2005 047 864
Oct. 20, 2005 (DE) ..... 10 2005 050 240

(51) Int. Cl.
*B63B 1/22* (2006.01)

(52) U.S. Cl. ..... 114/285; 440/61 T

(58) Field of Classification Search ..... 114/284, 114/285, 286, 287; 440/1, 53, 61 R, 61 T
See application file for complete search history.

(56) References Cited

U.S. PATENT DOCUMENTS 3,313,262 A * 4/1967 Yunker et al. ..... 114/287
3,695,204 A * 10/1972 Bennett ..... 114/286
3,977,349 A * 8/1976 Hummel ..... 114/287
4,261,278 A 4/1981 Gaudin
4,644,893 A 2/1987 Zepp
4,854,259 A * 8/1989 Cluett ..... 114/285
5,385,110 A * 1/1995 Bennett et al. ..... 114/285
6,583,728 B1 6/2003 Staerzl

FOREIGN PATENT DOCUMENTS

DE 27 43 154 B2 9/1977
DE 699 13 683 T2 4/1999

OTHER PUBLICATIONS

DE Office Action dated May 3, 2006.
GB Search Report No. GB0615254.0 dated Oct. 25, 2006.

* cited by examiner

*Primary Examiner*—Lars A. Olson
(74) *Attorney, Agent, or Firm*—Laurence P. Colton; Smith, Gmabrell & Russell

(57) ABSTRACT

A device for controlling trimming flaps (12, 13) of a watercraft (10), preferably having two trimming flaps (12, 13) and in each case at least one hydraulically operated for adjustment of the inclination angle (15) of the associated trimming flap (12, 13). The invention provides that the or each hydraulic system (18) has an associated flowmeter (21) which detects the flow of hydraulic fluid in the hydraulic system (18) in order to determine the inclination angle (15) of the associated trimming flap (12, 13). This makes it possible to dispense with external measurement devices for detection of the position of the trimming flaps, for example appropriate position sensors. The invention also relates to a corresponding method, and to watercraft having a corresponding device.

32 Claims, 4 Drawing Sheets

DEVICE AND METHOD FOR CONTROLLING TRIMMING FLAPS ON A WATERCRAFT, AS WELL AS A WATERCRAFT HAVING A CORRESPONDING DEVICE

BACKGROUND OF THE INVENTION

1. Technical Field

The invention relates to a device for controlling trimming flaps on a watercraft, having preferably two trimming flaps and in each case at least one hydraulically operated system for adjustment of the inclination angle of the associated trimming flap. The invention also relates to a watercraft preferably two trimming flaps for alignment of the watercraft at different speeds. The invention also relates to a method for controlling trimming flaps on a watercraft with the inclination angle of the trimming flaps being varied by means of a hydraulically operated system.

2. Prior Art

The trimming flaps under discussion here are generally arranged in the stern area of watercraft and are used to influence the attitude of the watercraft in the water at different speeds. The trimming flaps are preferably mounted on an approximately horizontally aligned pivoting shaft and can be pivoted with respect to the shaft, that is to say for example they can be raised or lowered via a hydraulically operated means, for example a hydraulic cylinder. The corresponding inclination angle of the trimming flap in this case governs the attitude of the watercraft in the water. The watercraft can be kept at an essentially flat attitude in the water by controlling the inclination angle of the trimming flaps.

The trimming flaps are generally controlled manually by the user, for example from the bridge of the watercraft. The inclination angle of the trimming flaps can be controlled by operation of appropriate switches, levers or the like. One problem relating to the control of the inclination angles of the trimming flaps is, in particular, that the optimum inclination angle is dependent on the speed of the watercraft and must therefore be adapted by the user in order that the watercraft is as far as possible always aligned at an optimum attitude (preferably essentially flat) in the water.

In general, the inclination angles of the trimming flaps are varied via hydraulically operated means, for example with the aid of hydraulic cylinders. In order to make it easier for the user to adjust the trimming flaps and their inclination angles, it is normal to indicate the position of the trimming flaps to the user. It is thus necessary to detect the current inclination angle of the trimming flaps in order, for example, to display this on the bridge by means of a suitable instrument, so that the user can make appropriate corrections, for example when the speed of the watercraft changes.

It is known in practice for the position of the trimming flaps to be detected by means of mechanical position sensors on the hydraulic cylinders. However, this requires wiring to the hydraulic cylinders in order to make it possible to detect, pass on and indicate the appropriate data. It has been found that this procedure has certain disadvantages because appropriate position sensors or signal lines may be damaged during operation, which damage must be repaired, and this is costly.

BRIEF SUMMARY OF THE INVENTION

Against this background, the invention is based on the object of further developing devices and methods of the type mentioned initially, in particular with respect to determination of the inclination angles of the trimming flaps in a manner which is as insensitive as possible to defects and with respect to automatically controlling the inclination angles in as simple a manner as possible.

A device for controlling trimming flaps of a watercraft, preferably having two trimming flaps and in each case at least one hydraulically operated system for adjustment of the inclination angle of the associated trimming flap, characterized in that the or each hydraulic system has an associated flowmeter which detects the flow of hydraulic fluid in the hydraulic system in order to determine the inclination angle of the associated trimming flap, proposed in order to achieve this object. The invention accordingly provides that the or each hydraulic system has an associated flowmeter which detects the flow of hydraulic fluid in the hydraulic system in order to determine the inclination angle of the associated trimming flap or flaps. A change to the inclination angle of the trimming flap or flaps can be determined by detection of the flow of the hydraulic fluid. For example, integration of the flowmeter in the hydraulic cylinder or in hydraulic lines which lead to the cylinder or in a comparable manner means that there is no need for wiring outside the hydraulic drive for the trimming flap or flaps in order to detect the position of the trimming flap or flaps. The damage which is known from the prior art can therefore not occur with the device according to the invention.

One preferred refinement of the invention provides that the hydraulic system has at least one hydraulic cylinder for adjustment of the inclination angle of the trimming flap or flaps, as well as a hydraulic unit for operation of the hydraulic cylinder, with the hydraulic cylinder and the hydraulic unit being connected by hydraulic lines. The flowmeter can preferably be associated with each of the hydraulic lines which lead from a hydraulic unit to the or each hydraulic cylinder. Furthermore, provision is preferably made that the hydraulic unit and the flowmeter are arranged inboard, and are thus protected against damage.

One preferred development of the invention provides that the or each hydraulic unit and/or the or each flowmeter is connected via lines to a control unit in order to control and/or indicate the inclination angle of the trimming flap or flaps. The control unit can thus be used to evaluate and/or to influence the position of the trimming flap or flaps. It is feasible on the one hand for the inclination angles of the trimming flap or flaps to be controlled automatically by the control unit. However, it is also feasible for the control unit to detect appropriate user commands and to implement them by operation of the hydraulic unit.

One particularly preferred development, which may also be used as an autonomous solution to achieve the initially mentioned object, provides that the inclination angles of the trimming flap or flaps can be controlled by the control unit automatically and as a function of the speed of the watercraft and/or of the rotation speed of a or each motor of the watercraft. This means that the control unit avoids the user having to carry out the task of matching the inclination angle of the trimming flap or flaps to the respective vehicle speed.

One preferred development of the invention provides that a trimming curve is stored in the control unit, from which a preferred inclination of the trimming flap or flaps as a function of the speed of the watercraft and/or of the motor rotation speed is obtained for automatic control of the inclination angle of the trimming flap or flaps. The trimming curve can preferably be varied by the user.

By way of example, the speed of the watercraft can be determined in a simple manner by means of a GPS receiver, which passes the corresponding data to the control unit in order in this way to allow the inclination angles of the trimming flap or flaps to be controlled.

A corresponding method in order to carry out the object mentioned in the introduction is a method for controlling trimming flaps of a watercraft, with the inclination angle of the trimming flaps being varied by means of a hydraulically operating system, characterized in that the hydraulic system has an associated flowmeter by means of which the flow of the hydraulic fluid is measured in order to determine the inclination angle of the trimming flap. This provides that the hydraulic system has an associated flowmeter by means of which the flow of the hydraulic fluid is measured in order to determine the inclination angle of the trimming flap or flaps. In this case as well, a change in the inclination angle can be detected in principle by monitoring the flow of the hydraulic fluid. Starting from a known actual inclination angle, for example the maximum or minimum inclination angle, the current inclination angle can thus be determined by observation of the change in the inclination angle.

Preferred developments of the invention are specified in the dependent claims.

BRIEF DESCRIPTION OF THE DRAWINGS

One preferred exemplary embodiment of the invention will be explained in more detail in the following text with reference to the drawings, in which.

DETAILED DESCRIPTION OF THE PREFERRED EMBODIMENTS

FIGS. 1 to 6 show one preferred embodiment of a system for controlling the inclination angle of trimming flaps on a watercraft. It is self-evident that the following description of the exemplary embodiment indicates only one of many options for implementation of the invention. In principle, departures may be made at individual points from the described solution without departing from the fundamental idea of the invention. The following description should in no way be regarded as any restriction to the scope of protection of the patent claims to the described exemplary embodiment.

Figure 1:
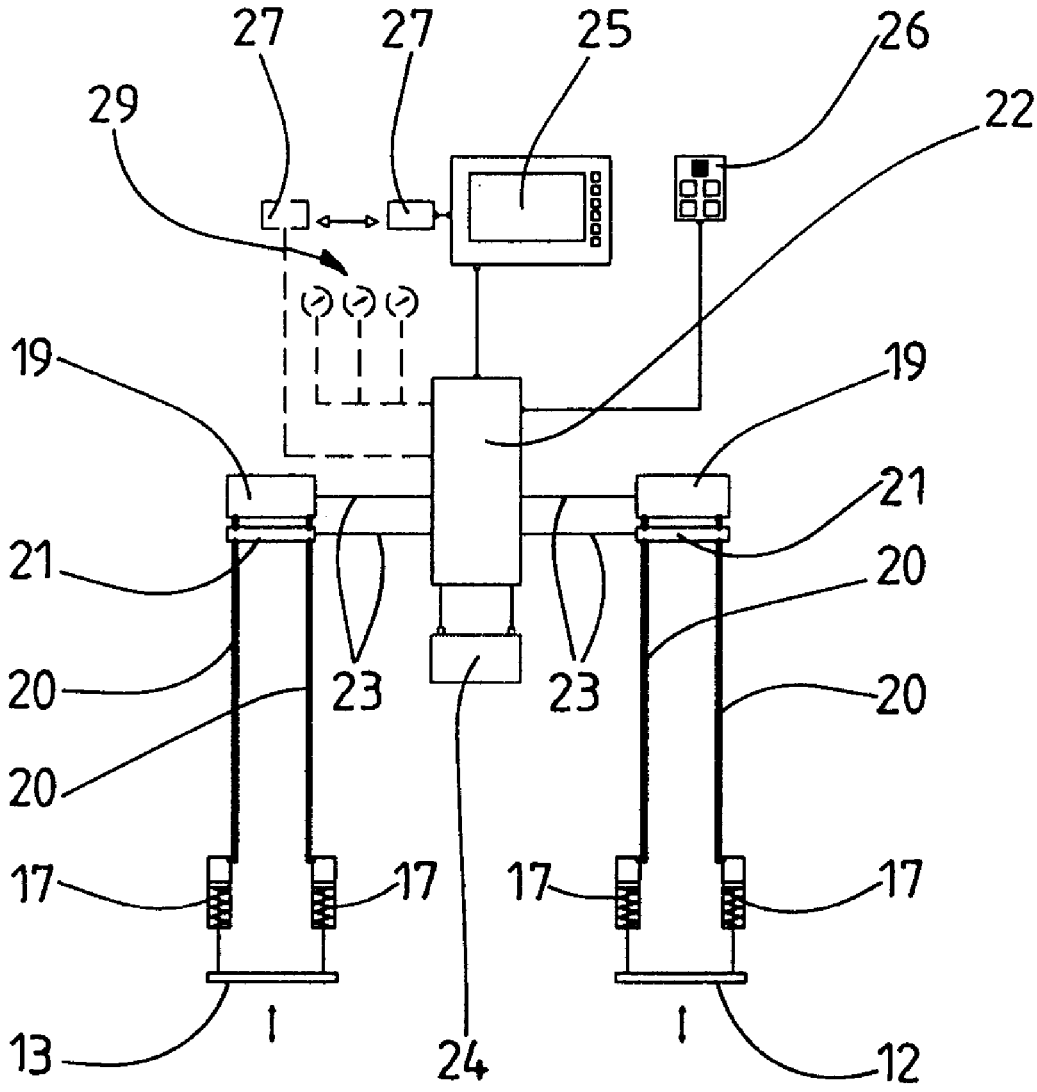
FIG. 1 shows a schematic illustration of a system for controlling the inclination angle of trimming flaps on a watercraft.
Figure 2:
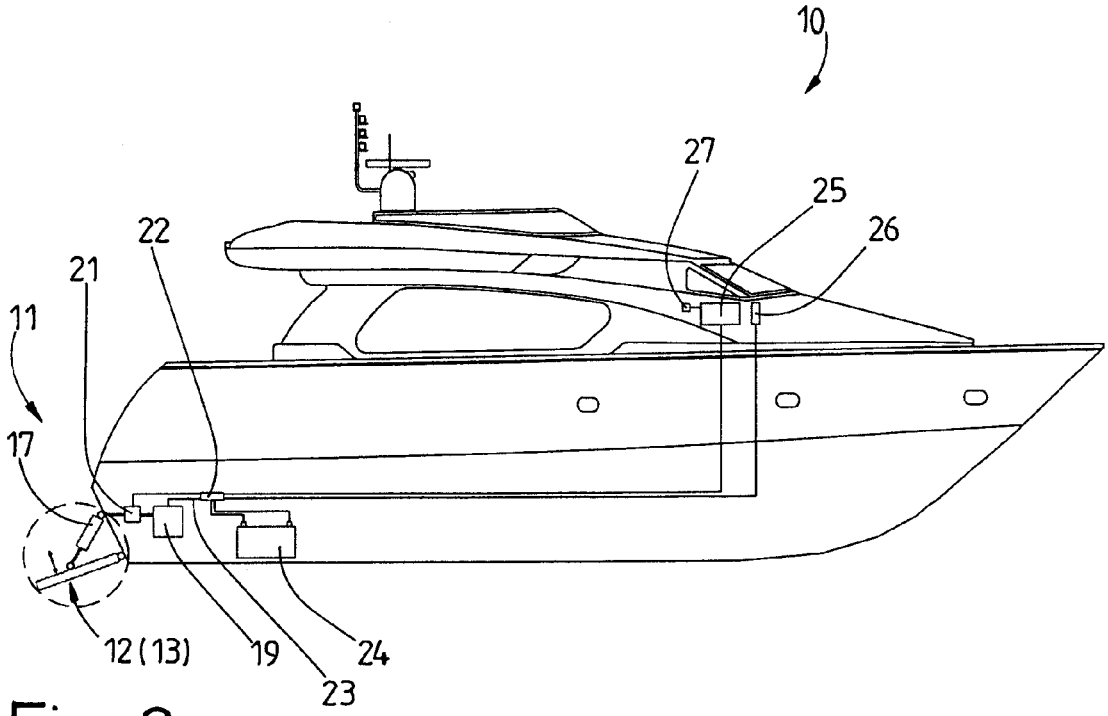
FIG. 2 shows a side view of a watercraft with trimming flaps.

FIG. 2 shows a side view of a watercraft 10. Two trimming flaps 12, 13 are arranged in the area of the stern 11 of the watercraft, to be precise a starboard trimming flap 12 and a port trimming flap 13.

In a plan view, the two trimming flaps 12, 13 are preferably arranged at the same distance laterally from the longitudinal center axis of the watercraft 10, which is not shown. The two trimming flaps 12, 13 are each mounted on the watercraft 10 such that they can pivot. The bearing is in the form of a hinge-like joint 14 in the area of the stern 11. The hinge-like joint 14 is aligned approximately horizontally and is preferably arranged underneath the water level.

Figure 3:
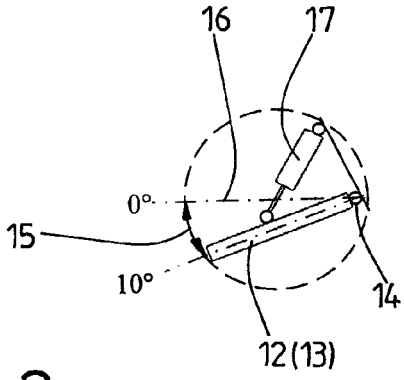
FIG. 3 and FIG. 4 show various positions of the trimming flap.
Figure 4:
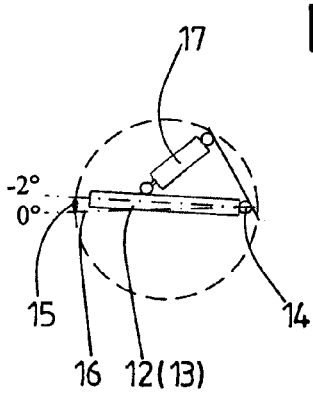
Figure 5:
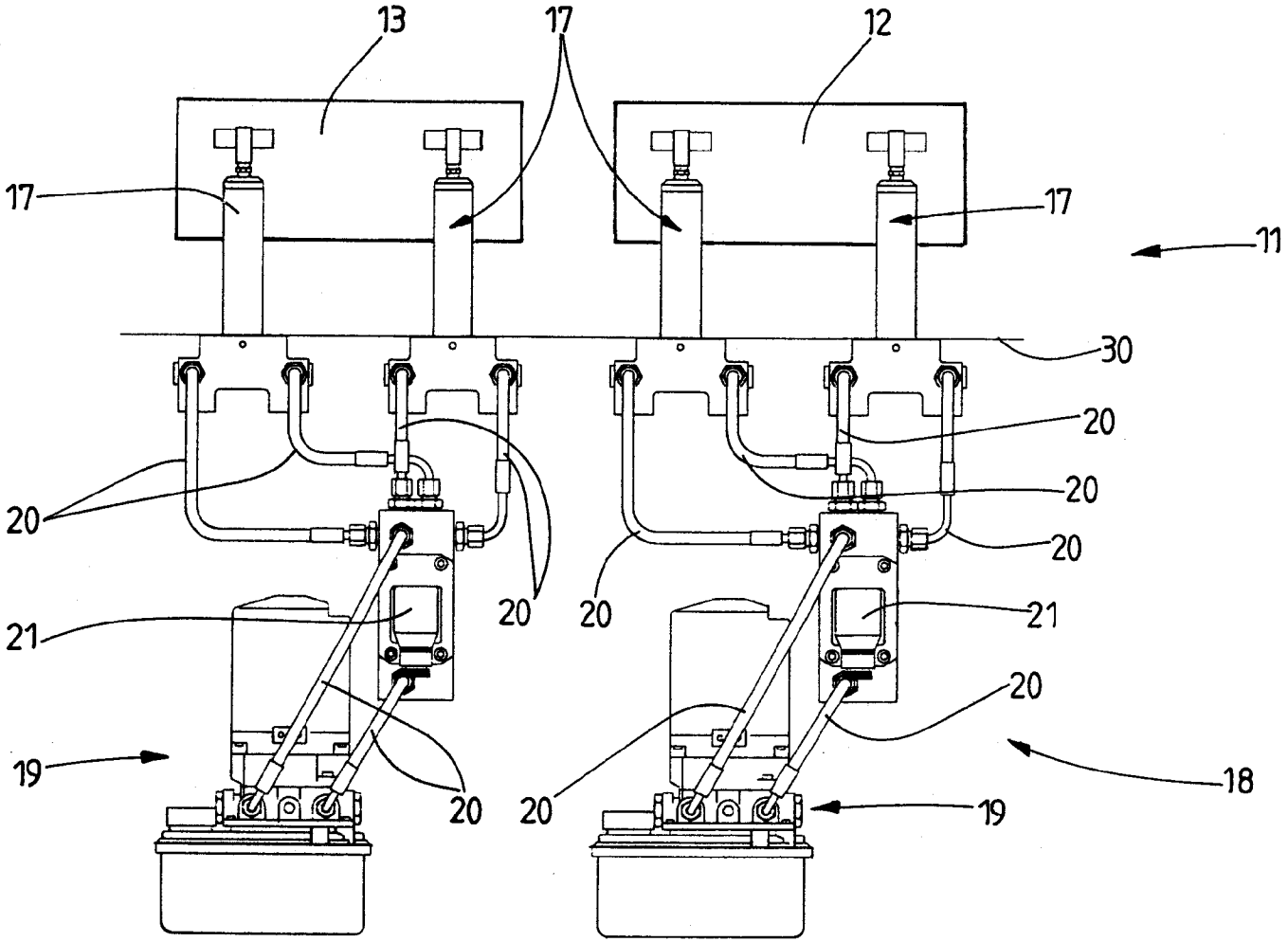
FIG. 5 shows a schematic illustration of the hydraulic operation of the trimming flaps.

The trimming flaps 12, 13 can be pivoted in the vertical direction about the joints 14, specifically between an upper limit position (FIG. 4) and a lower limit position (FIG. 3). The capability of the trimming flaps 12, 13 to pivot changes their inclination angles 15 with respect to an imaginary horizontal plane 16 which runs through the axis of the joint 14. In the illustrated exemplary embodiment, the trimming flaps 12, 13 point 2° upwards in the upper limit position shown in FIG. 4. The inclination angle 15 in the lower limit position as shown in FIG. 3 is approximately 10°. The inclination angles 15 in the upper and lower limit positions are freely configurable and can be matched to the respective requirements and circumstances.

In principle the trimming flaps 12, 13 are used to influence the attitude of the watercraft 10 in the water. For this purpose, the trimming flaps 12, 13 are adjusted as a function of the speed of the watercraft 10 such that the watercraft 10 remains essentially flat in the water. In principle, the trimming flaps 12, 13 can be pivoted both synchronously and individually.

The trimming flaps 12, 13 are pivoted via hydraulic cylinders 17. The hydraulic cylinders 17 are arranged above the trimming flaps 12, 13 at the stern 11 of the watercraft 10, and are connected to the upper face of the trimming flaps 12, 13. The inclination angle 15 of the trimming flaps 12, 13 can be adjusted in this way, by extension and retraction of the hydraulic cylinder 17.

Each trimming flap 12, 13 may use one or more hydraulic cylinders 17. The hydraulic cylinders 17 may be single-acting or double-acting hydraulic cylinders 17. In the present exemplary embodiment each trimming flap 12, 13 in each case has two associated hydraulic cylinders 17, which are in the form of double-acting cylinders (see FIG. 5).

The hydraulic cylinders 17 are part of hydraulically operated systems for adjustment of a trimming flap 12, 13, referred to for short in the following text as a hydraulic system 18. In the present exemplary embodiment, as described above, a hydraulic system 18 has a hydraulic cylinder 17, a hydraulic unit 19 and the hydraulic lines 20 which run between the hydraulic unit 19 and the hydraulic cylinders 17. Each trimming flap 12, 13 and the hydraulic cylinders 17 arranged on it are in this case associated with one and only one hydraulic system 18 with a separate hydraulic unit 19, so that the trimming flaps can be operated independently of one another.

One special feature is that one flowmeter 21 is in each case integrated in each circuit in the hydraulic system 18. The flow of the hydraulic fluid within the respective hydraulic system 18 can be determined with the aid of the flowmeters 21. The change in the inclination angles 15 of the trimming flaps 12, 13 can then be deduced from the change in the flow of the hydraulic fluid. The flowmeters 21 are preferably integrated in the hydraulic lines 20. This allows the flowmeters 21 to be positioned inboard, so that they are protected against external influences and damage. The appropriate position of the transom 30 is evident, for example, from the schematic illustration shown in FIG. 5. Alternatively, it is also feasible to associate the flowmeters 21 with the hydraulic cylinders 17 or the hydraulic units 19.

The flowmeters 21 are used to determine the flow of hydraulic fluid in the hydraulic system 18. For this purpose, the system must first of all be calibrated. For this purpose, the trimming flaps 12, 13 are first of all moved to one limit position, and then to the other limit position. During this process, the flow of hydraulic fluid is recorded, and a measure is obtained for the maximum movement. The flowmeters 21 in this case produce a number of pulses, as data, proportional to the amount of flow. In this case, one pulse in each case corresponds to a specific amount or a specific flow volume.

The system is controlled by a central control unit 22. The control unit is connected by means of electronic lines 23 to the hydraulic units 19 and the flowmeters 21. Furthermore, a voltage supply 24 is provided in order to supply at least the control unit 22. The central control unit 22 can calculate the variation in the inclination angle of the trimming flaps 12, 13 on the basis of the pulses which are transmitted from the flowmeters 21 during the calibration and during operation. The position of the trimming flaps 12, 13 can then be indicated on the bridge of the watercraft 10 by means of the display 25 which is connected to the control unit 22.

Furthermore, a control panel 26 is provided, and can likewise be connected to the central control unit 22. The control panel 26 allows the inclination angle 15 of the trimming flaps 12,13 to be varied manually. A separate button for pivoting the respective trimming flap 12 or 13 up or down is provided for this purpose for each respective trimming flap 12 or 13.

As a further special feature, the inclination angles 15 of the trimming flaps 12,13 can also be controlled automatically. In this case, the inclination angles 15 can be controlled as a function of the speed of the watercraft 10 and/or of the rotation speed of the or each motor.

In the illustrated exemplary embodiment, a GPS receiver 27 is connected to the display 25. The GPS receiver 27 provides information about the speed of the watercraft 10, in the normal manner. The speed can on the one hand be indicated on the display 25 and is on the other hand transmitted to the control unit 22.

A trimming curve 28 is stored in the control unit 22, indicating the preferred inclination angles 15 as a function of the speed of the watercraft and the motor rotation speed. The following Table 1 contains examples of data for a trimming curve 28 such as this, for illustrative purposes:

TABLE 1

| RPM | Max. GPS speed (kn) | Trim angle (°) |
|---|---|---|
| 700 | 7.6 | −4.0 |
| 800 | 8.3 | −4.0 |
| 900 | 9.1 | −4.0 |
| 1000 | 10.0 | −4.0 |
| 1100 | 10.7 | −4.0 |
| 1200 | 11.4 | −4.0 |
| 1300 | 12.0 | −4.0 |
| 1400 | 12.6 | −4.0 |
| 1500 | 13.3 | −4.0 |
| 1600 | 15.8 | 5.0 |
| 1700 | 17.4 | 5.0 |
| 1800 | 19.0 | 5.5 |
| 1900 | 20.9 | 5.5 |
| 2000 | 23.0 | 3.0 |
| 2100 | 25.1 | 3.0 |
| 2200 | 26.9 | 3.5 |
| 2300 | 28.6 | 4.0 |
| 2348 | 29.5 | 5.5 |

Figure 6:
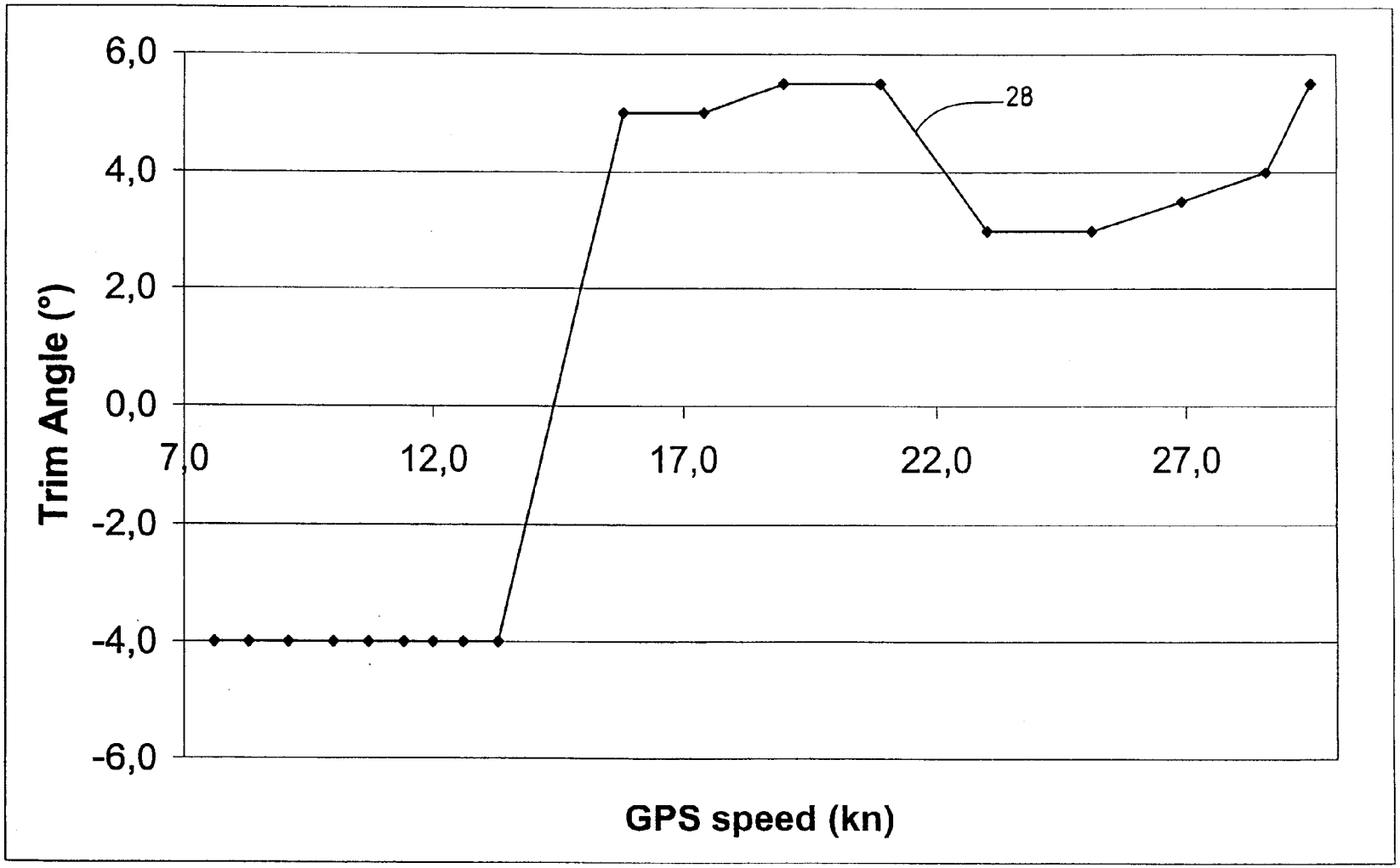
FIG. 6 shows a trimming curve for automatic control of the inclination angle of the trimming flaps as a function of the speed of the watercraft.

FIG. 6 also illustrates a corresponding trimming curve 28. The trimming curve 28 can also be varied by the user. For example, it is feasible to indicate the data or the trimming curve 28 on the display 25. The data can also be varied as required by means of the control panel 26 or by some other input means.

If no display 25 is provided, the GPS receiver 27 can also alternatively be connected directly to the central control unit 22. This solution is illustrated by dashed lines in FIG. 1. The figure does not show the transmission of the motor rotation speeds to the central control unit 22.

Dashed lines are likewise used to illustrate further indication instruments which may be provided as an alternative to and/or in addition in the display 25. This or these is or are in the form of one or more instruments 29 on which, for example, it is possible to display the best position of the trimming flaps 12, 13 and the existing positions of the trimming flaps 12, 13.

In order to allow switching between automatic control of the trimming flaps 12, 13 and manual control, provision is made for an appropriate switch which, in the illustrated exemplary embodiment, is associated with the control panel 26.

The control unit 22 can preferably be connected to the instruments, displays, control panels, units and instrument via a CAN bus.

Since the control unit 22 and the flowmeters 21 detect only the change in the inclination angle 15 of the trimming flaps 12, 13, an initial position of the trimming flaps 12, 13 must first of be determined when the system is being started up.

This can be done on the one hand by storing the last position of the trimming flaps 12, 13. However, the trimming flaps 12, 13 are preferably moved to one of the two limit positions of starting up the watercraft 10, thus redefining the reference value or the initial position.

Furthermore the trimming flaps are preferably moved to the upper limit position automatically when the or each motor is switched off, and are in this way calibrated.

As described above, a trimming curve (28) can be used for automatic control of the inclination angles (15) of the trimming flaps (12, 13), and is preferably stored in the control unit (22). The trimming curve (28) can be indicated on the display (25) and can be varied by the control panel (26). Alternatively, a PC or laptop can also be connected to the control unit (22) or to some other point in the system in order to read the trimming curve (28) which is stored in the system, to edit it and to transmit it to the system again, with the aid of a suitable program.

Furthermore, it is also possible to provide for the capability for the trimming curve (28) also to be stored by the PC or laptop on a data storage medium. This allows different trimming curves (28) to be kept available, which can be played back to the system as required. On the other hand, the trimming curves (28) which are created manually using the control panel (26) can be saved on the PC, laptop or data storage medium.

By way of example, the PC or laptop can be connected with the aid of a serial cable.

Up to 50 values (increase in speed in knots and inclination angle (15) in degrees) can be entered in an appropriate table, and can be processed further, by means of the PC or laptop keyboard. The data which is 35 entered is preferably also displayed graphically.

During the downloading of the trimming curve (28) to the PC or laptop, the data relating to the trimming curve (28) is displayed as a table and graphically on an appropriate user interface, while the data can be processed further by the user. A progress bar is overlaid during the transmission process.

During uploading of the trimming curve (28), the successful procedure is signaled by confirmation on the user interface. Once again, a progress bar is overlaid during the transmission process.

| List of reference symbols: | |
|---|---|
| 10 | Watercraft |
| 11 | Stern |
| 12 | Starboard trimming flap |
| 13 | Port trimming flap |
| 14 | Joint |
| 15 | Inclination angle |
| 16 | Plane |
| 17 | Hydraulic cylinder |
| 18 | Hydraulic system |
| 19 | Hydraulic unit |
| 20 | Hydraulic line |
| 21 | Flowmeter |
| 22 | Control unit |
| 23 | Line |
| 24 | Voltage supply |
| 25 | Display |
| 26 | Control panel |
| 27 | GPS receiver |
| 28 | Trimming curve |
| 29 | Instrument |
| 30 | Transom |

The invention claimed is:

1. Device for controlling trimming flaps (12, 13) of a watercraft (10) having at least one hydraulic system (18) for adjustment of an inclination angle (15) of the associated trimming flap (12, 13), characterized in that each of the at least one hydraulic system (18) has an associated flowmeter (21) which detects the flow of hydraulic fluid in the respective hydraulic system (18) in order to determine the inclination angle (15) of the associated trimming flap (12, 13).

2. Device for controlling trimming flaps (12, 13) according to claim 1, characterized in that each of the at least one hydraulic system (18) has at least one hydraulic cylinder (17) for adjustment of the inclination angle of the trimming flap (12, 13), as well as a hydraulic unit (19) for operation of the hydraulic cylinder (17), with the hydraulic cylinder (17) and the hydraulic unit (19) being connected by hydraulic lines (20).

3. Device for controlling trimming flaps (12, 13) according to claim 2, characterized in that the flowmeter (21) is in each case associated with the hydraulic lines (20) which lead from the hydraulic unit (19) to the at least one hydraulic cylinder (17).

4. Device for controlling trimming flaps (12, 13) according to claim 2, characterized in that the hydraulic unit (19) and the flowmeter (21) are arranged inboard.

5. Device for controlling trimming flaps (12, 13) according to claim 2, characterized in that the hydraulic unit (19) and the flowmeter (21) are connected via lines (23) to a control unit (22) in order to control and indicate the inclination angle (15) of the trimming flaps (12, 13).

6. Device for controlling trimming flaps (12, 13) according to claim 2, characterized in that the hydraulic unit (19) is connected via lines (23) to a control unit (22) in order to control the inclination angle (15) of the trimming flaps (12,13).

7. Device for controlling trimming flaps (12, 13) according to claim 2, characterized in that the flowmeter (21) is connected via lines (23) to a control unit (22) in order to control the inclination angle (15) of the trimming flaps (12, 13).

8. Device for controlling trimming flaps (12, 13) according to claim 5, characterized in that the inclination angles (15) of the trimming flaps (12, 13) can be controlled automatically by the control unit (22) as a function of the speed of the watercraft (10).

9. Device for controlling trimming flaps (12, 13) according to claim 5, characterized in that the inclination angles (15) of the trimming flaps (12, 13) can be controlled automatically by the control unit (22) as a function of the rotation speed of a motor of the watercraft (10).

10. Device for controlling trimming flaps (12, 13) according to claim 5, characterized in that a trimming curve (28) is stored in the control unit (22), from which a preferred inclination of the trimming flaps (12, 13) as a function of the speed of the watercraft (10) is obtained for automatic control of the inclination angle (15) of the trimming flaps (12, 13).

11. Device for controlling trimming flaps (12, 13) according to claim 10, characterized in that the trimming curve (28) can be varied by the a user.

12. Device for controlling trimming flaps (12, 13) according to claim 5, characterized in that a trimming curve (28) is stored in the control unit (22), from which a preferred inclination of the trimming flaps (12, 13) as a function of the motor rotation speed is obtained for automatic control of the inclination angle (15) of the trimming flaps (12, 13).

13. Device for controlling trimming flaps (12, 13) according to claim 12, characterized in that the trimming curve (28) can be varied by the a user.

14. Device for controlling trimming flaps (12, 13) according to claim 5, characterized in that the trimming flaps (12, 13) can be controlled separately from one another by the control unit (22).

15. Device for controlling trimming flaps (12, 13) according to claim 5, characterized in that the inclination angles (15) of the trimming flaps (12, 13) can be controlled automatically by the control unit (22).

16. Device for controlling trimming flaps (12, 13) according to claim 5, characterized in that the inclination angles (15) of the trimming flaps (12, 13) can be controlled automatically by the control unit (22) as a function of the speed of the watercraft (10) and of the rotation speed of a motor of the watercraft (10).

17. Device for controlling trimming flaps (12, 13) according to claim 5, characterized in that a trimming curve (28) is stored in the control unit (22), from which a preferred inclination of the trimming flaps (12, 13) as a function of the speed of the watercraft (10) and of the motor rotation speed is obtained for automatic control of the inclination angle (15) of the trimming flaps (12, 13).

18. Device for controlling trimming flaps (12, 13) according to claim 17, characterized in that the trimming curve (28) can be varied by the a user.

19. Device for controlling trimming flaps (12, 13) according to claim 5, characterized in that the control unit (22) has an associated display (25) for indication of the inclination angle (15) of the or each trimming flap (12, 13).

20. Device for controlling trimming flaps (12, 13) according to claim 19 characterized in that the trimming curve which is stored in the controller (22) can be indicated on the display (25) and can be varied by means of the control panel (26).

21. Device for controlling trimming flaps (12, 13) according to claim 5, characterized In that the control unit (22) has an associated control panel (26) for manual control of the inclination angle (15) of the or each trimming flap (12, 13).

22. Device for controlling trimming flaps (12,13) according to claim 5, characterized in that the speed of the watercraft (10) can be determined by means of a GPS receiver (27), which passes on appropriate data to the control unit (22) for automatic control of the inclination angle (15) of the trimming flaps (12, 13) as a function of the speed of the watercraft (10).

23. Watercraft having trimming flaps (12, 13) for alignment of the watercraft (10) at different speeds, characterized by a device for controlling the inclination angle (15) of the trimming flaps (12, 13) according to claim 1.

24. Method for controlling trimming flaps (12, 13) according to claim 1, characterized in that the simple calibration is carried out automatically before the start of each trip.

25. Watercraft having two trimming flaps (12, 13) for alignment of the watercraft (10) at different speeds, characterized by a device for controlling the inclination angle (15) of the trimming flaps (12, 13) according to claim 1.

26. Method for controlling trimming flaps (12, 13) of a watercraft (10), with the inclination angle (15) of the trimming flaps (12, 13) being varied by means of a hydraulically operating system (18), characterized in that the hydraulic system (18) has an associated flowmeter (21) by means of which the flow of the hydraulic fluid is measured in order to determine the inclination angle (15) of the trimming flap (12, 13).

27. Method of controlling trimming flaps (12, 13) according to claim 26, characterized in that, for initial calibration of the system (18), the or each trimming flap (12, 13) is first of all moved to a first limit position and then to an opposite limit position in order to determine the flow in the hydraulic system (18).

28. Method for controlling trimming flaps (12, 13) according to claim 27, characterized in that the trimming flaps (12, 13) are moved to one limit position for simple calibration of the system (18).

29. Method for controlling trimming flaps (12, 13) according to claim 28, characterized in that the simple calibration is carried out before the start of each trip.

30. Method for controlling trimming flaps (12, 13) according to claim 26, characterized in that the inclination angles (15) of the trimming flaps (12, 13) are controlled automatically by a control unit (22).

31. Method for controlling trimming flaps (12, 13) according to claim 30, characterized in that the inclination angles (15) of the trimming flaps (12, 13) are controlled automatically by the control unit (22) as a function of the speed of the watercraft (10) and/or of the rotation speed of a or each motor of the watercraft (10).

32. Method for controlling trimming flaps (12, 13) according to claim 31, characterized in that a trimming curve (28) is stored in the control unit (22), from which a preferred inclination of the trimming flaps (12, 13) as a function of the speed of the watercraft (10) and/or of the motor rotation speed is obtained for automatic control of the inclination angle (15) of the trimming flaps (12, 13).

* * * * *